US007210992B1

(12) United States Patent
Wade

(10) Patent No.: US 7,210,992 B1
(45) Date of Patent: May 1, 2007

(54) MACHINE FOR PREPARING FLOORS FOR REFINISHING

(76) Inventor: Fred Wade, 4742 42nd Ave. SW. #632, Seattle, WA (US) 98271

( * ) Notice: Subject to any disclaimer, the term of this patent is extended or adjusted under 35 U.S.C. 154(b) by 0 days.

(21) Appl. No.: 11/505,133

(22) Filed: Aug. 16, 2006

(51) Int. Cl.
*B24B 23/03* (2006.01)

(52) U.S. Cl. ..... 451/344; 451/350; 125/38; 299/36.1

(58) Field of Classification Search ..... 451/344, 451/350; 125/2, 38, 40; 299/36.1, 37.1, 299/37.3
See application file for complete search history.

(56) References Cited

U.S. PATENT DOCUMENTS 4,097,950 A * 7/1978 Satterfield ..... 15/49.1
5,695,389 A * 12/1997 Bartel et al. ..... 451/92
5,772,497 A * 6/1998 Dummermuth ..... 451/350
6,739,957 B2 * 5/2004 Peterson et al. ..... 451/162
6,752,707 B1 * 6/2004 Palushi ..... 451/350

* cited by examiner

*Primary Examiner*—Lee D. Wilson
*Assistant Examiner*—Anthony Ojini
(74) *Attorney, Agent, or Firm*—Michael J. Tavella

(57) ABSTRACT

A floor preparation machine that uses a number of vertical needles positioned in a tight rectangular pattern. The needles vibrate against the floor surface to prepare the floor surface. The needles are driven by a cam and cam follower. As the cam is turned by a motor, a number of ribs repeatedly contact the cam follower, which in turn repeatedly pushes the needles down. Under the top plate that supports the needles, is a rubber form that acts as a "spring" to force the needles up after they have been pushed down by the cam follower. In practice, the system produces a sustained vibration of the needles that breaks the surface to a depth of 1/16 to 1/8 of an inch.

18 Claims, 13 Drawing Sheets

MACHINE FOR PREPARING FLOORS FOR REFINISHING

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates floor refinishers and particularly to a floor refinisher using needles to break epoxy coatings.

2. Description of the Prior Art

Modern floors in commercial buildings are often finished with epoxy coatings. This produces a durable smooth finished surface. Overtime, however, these surfaces wear and need to be resurfaced. Before a new surface layer of epoxy coating can be poured, the original surface must be prepared. This is normally accomplished by roughing up the surface to break up the old coating. This is normally done to a depth of between 1/16 and 1/2 of an inch. This prepared surface is then able to take a new coating of epoxy that is smooth and like new.

The current method used to prepare the surface of the floors involves the use of a shot blaster. A shot blaster is a device that uses small steel balls (shot) that are blasted into the floor surface. A machine holds the shot and provides the force for blasting them into the floor. The machine has a powerful vacuum to pull the shot back into the machine as they are blasted out. This machine does produce a properly prepared floor for refinishing. However, they have some problems. First, they are large. Even the smaller units are too large to fit easily into corners. This means that the edges of the floor have to be broken up by hand. This is a slow and difficult process that can result in injuries to workers. Another problem is that the use steel shot—typically a thousand pounds of shot or more are required for a typical job. This increases shipping costs, especially to rural areas. Furthermore, despite the powerful vacuum, the machine does not recover all of the shot pellets. This means that workers must take time to clean up the shot pellets after the job. It also requires extra quantities of shot be kept on hand to refill the machine as needed. This further increases the cost of the job.

Another device that can be used for floor preparation is a head scabbler. This device uses carbide percussive cutting heads to pound the floor surface. The heads are circular and have four protrusions per head that contact the floor surface. The heads are also positioned in a rectangular spaced-apart pattern. The device is small it has a 12 inch wide cutting path. This is a powerful machine that can do the job, but still is not large enough to do large areas efficiently. Moreover, the spaced-apart pattern of cutting heads requires the operator to mover over an area multiple times to ensure a properly prepared surface. Finally, the spaced-apart pattern does nothing to help prepare the edges of a room. This means that these areas must be done by hand also.

BRIEF DESCRIPTION OF THE INVENTION

The instant invention overcomes these problems. It is a floor preparation machine that uses a number of vertical needles positioned in a tight rectangular pattern. The needles vibrate against the floor surface to prepare the floor surface without the intensity of a shot blaster or the head scabbler discussed above. The needles act in a similar manner to an engraver's tool working on metal. Moreover, because the needles are positioned in a tight pattern, there are no missed areas left when a machine completes a pass. Finally, the placement of the needles is such that the machine can be operated immediately adjacent to walls, which eliminates all handwork to finish the edges.

In the preferred embodiment, the needles are positioned into a rectangular form. They are secured by a top plate that that fits into a frame that permits the top plate to move vertically. The needles are driven by a cam and cam follower. The cam is turned by a motor. The cam is a cylinder that has a number of ribs extending out from the surface. The cam follower is positioned below the cam. As the cam is turned, the finds repeatedly contact the cam follower, which in turn repeatedly pushes the needles down. Under the top plate that supports the needles, is a rubber body. The rubber acts as a "spring" to force the needles up after they have been pushed down by the cam follower.

In practice, the system produces a sustained vibration of the needles that breaks the surface to a depth of 1/16 to 1/8 of an inch.

Thus, with one machine it is possible to completely prepare a floor with one continuous operation. Moreover, because the unit is self-contained, there are not large quantities of shot pellets to carry, as in the case of the shot blaster. Finally, because the needles operate with less impact, the machine can be made large enough to cover a reasonable area of the floor with each pass, which reduces the time spent on the floor preparation.

DETAILED DESCRIPTION OF THE INVENTION

Figure 1:
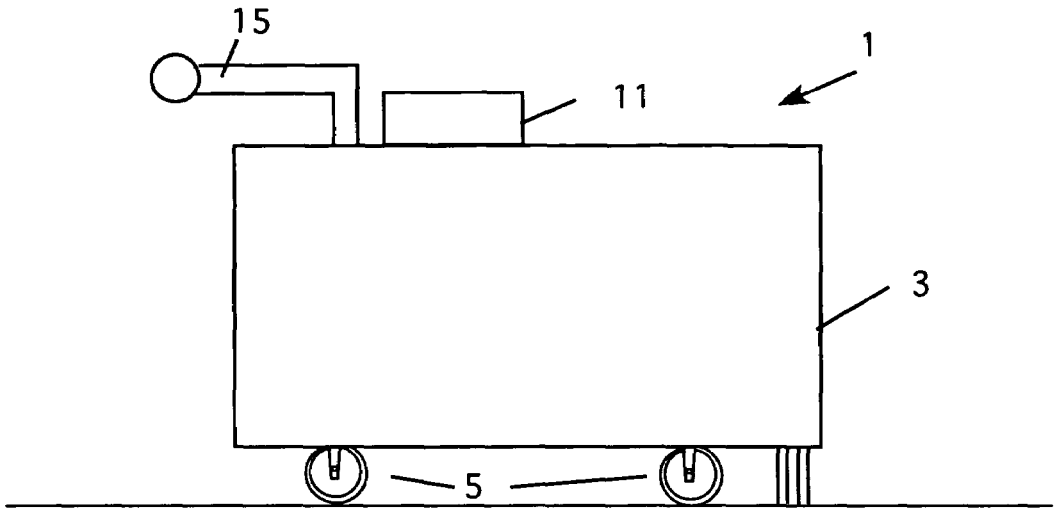
FIG. 1 is a side view of the invention.
Figure 2:
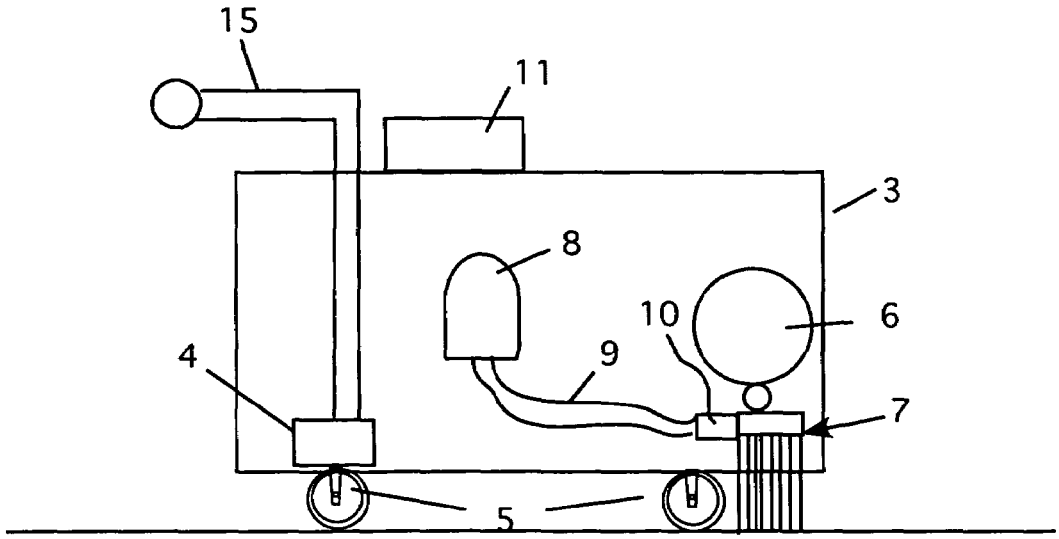
FIG. 2 is an interior side view of the invention showing the major internal components of the invention.

Referring now to FIGS. 1 and 2, the invention 1 consists of a frame and housing 3 that supports a number of components. The machine 1 is designed to operate on wheels 5. It has a housing 3 that holds a drive motor 4, to drive a set of wheels 5. A needle drive system 6 is also provided to operate the needles 7 that are mounted in the front of the machine.

A vacuum 8 that has a duct 9 that connects to the needle drive system 6 at nozzle is provided to help remove dust produced by the machine.

The machine 1 has a control panel 11 mounted on the top. The control panel includes controls that control the speed or intensity of the needles in their application to the floor surface. The machine has a handlebar 15. The handlebar 15 is used to control the direction and speed of the drive motor 4 by the operator. In the preferred embodiment, it has a "dead man" drive bar to shut down the machine when the handlebar is released.

Figure 3:
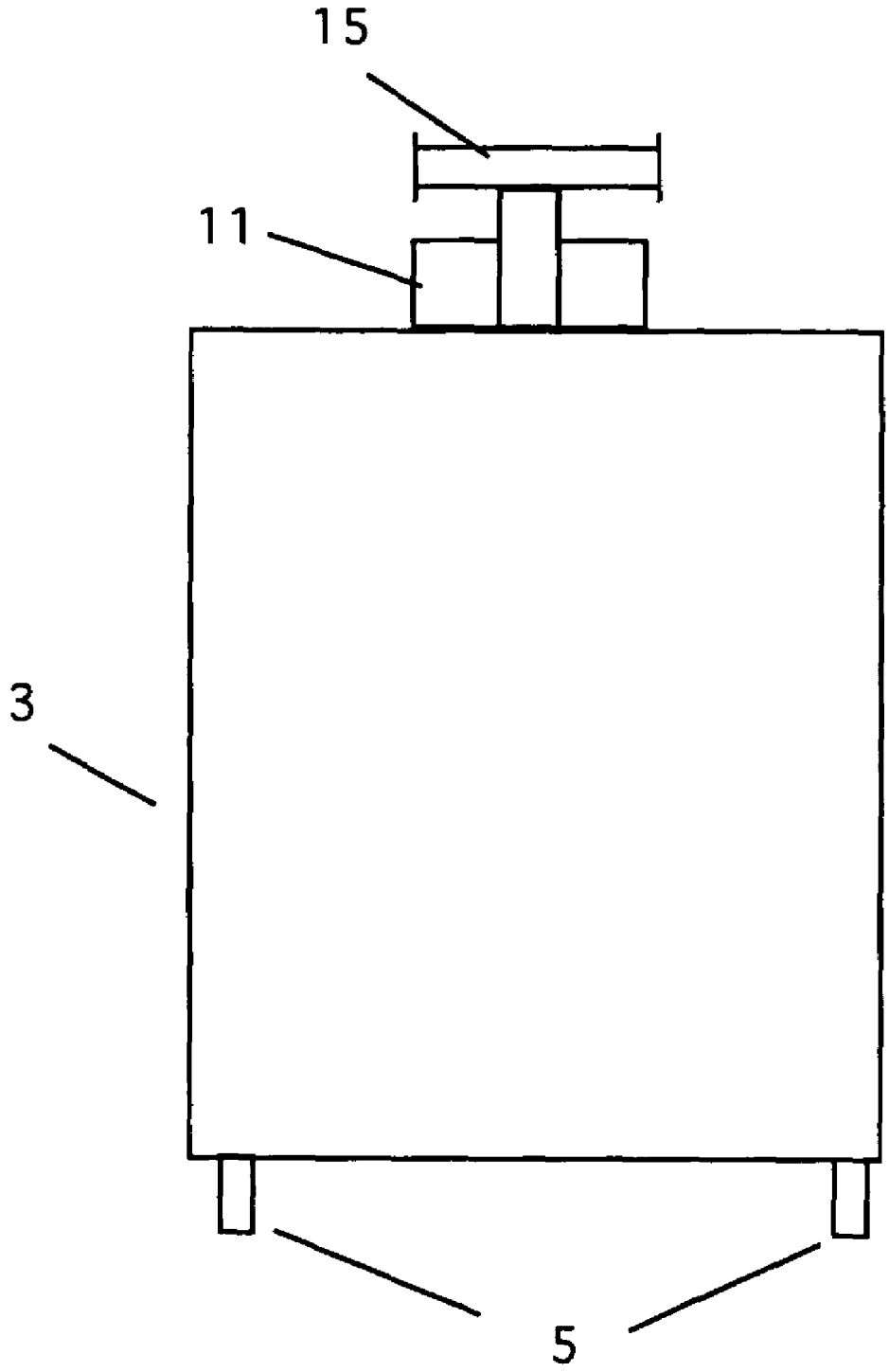
FIG. 3 is a rear view of the invention.

FIG. 3 is a rear view of the invention. Here, the housing 3, wheels 5, control panel 11 and the handle 15 are shown.

Figure 4A:
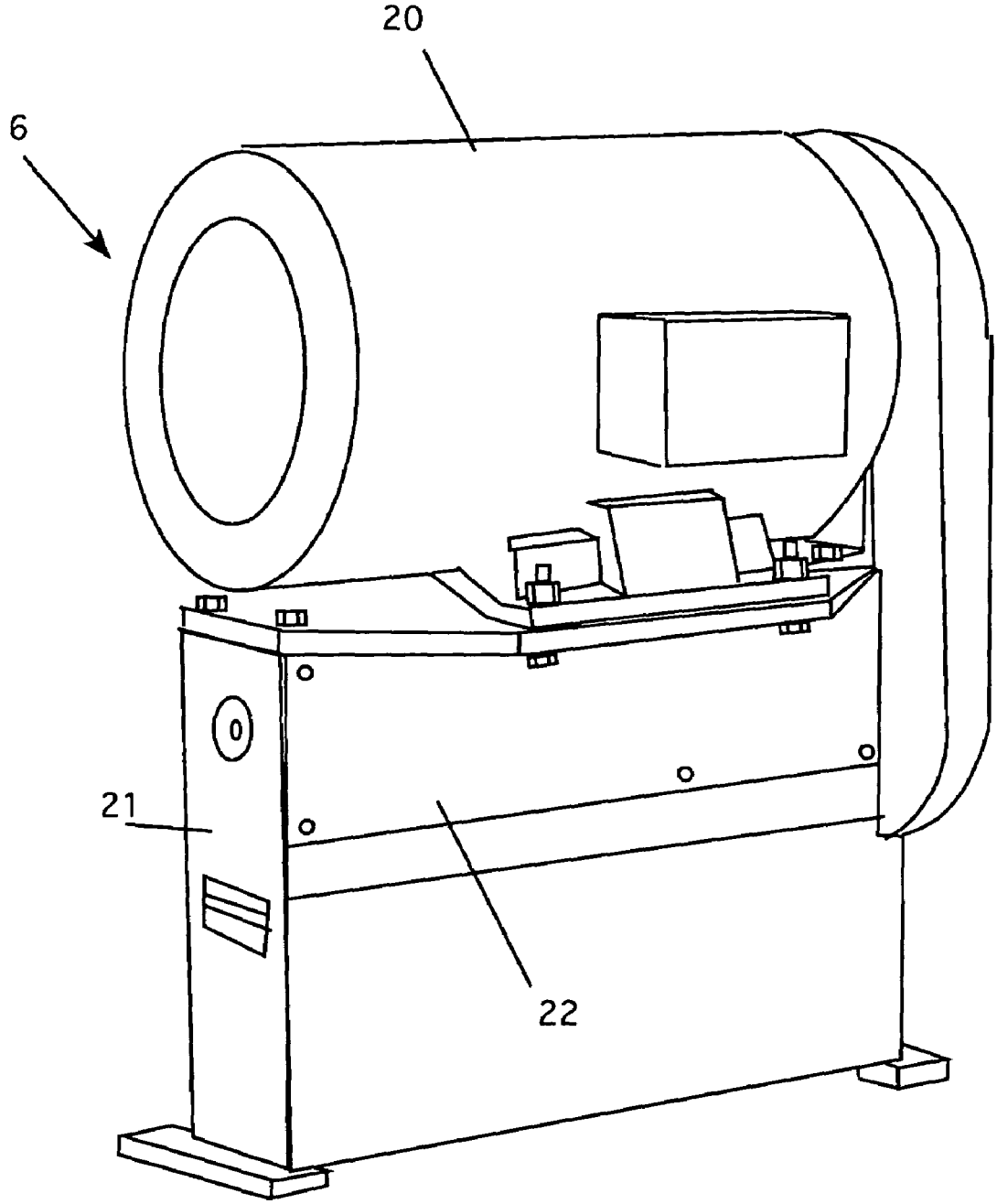
FIG. 4*a* is a left side front perspective view of the needle drive assembly.

FIG. 4*a* is a left side front perspective view of the needle drive assembly 6. This assembly consists of several components, discussed below. All the components, except for the motor 20, are housed in a housing 21. The motor 10 is an industrial type with a typical speed of 1800 rpm and a horsepower of ???. The motor 20 is bolted to the top of the housing 21 as shown.

Figure 4B:
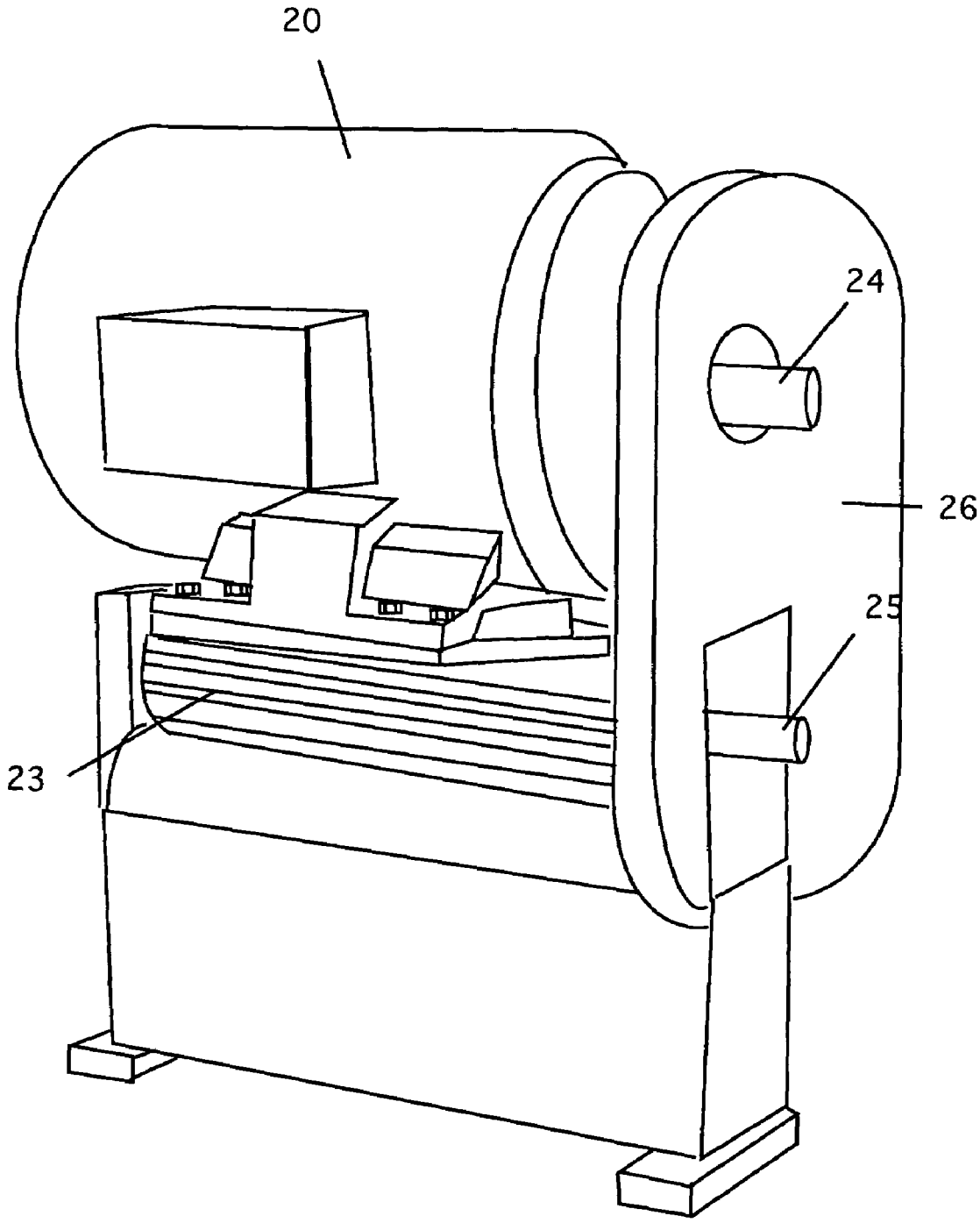
FIG. 4*b* is a right side front perspective view of the needle drive assembly.
Figure 13:
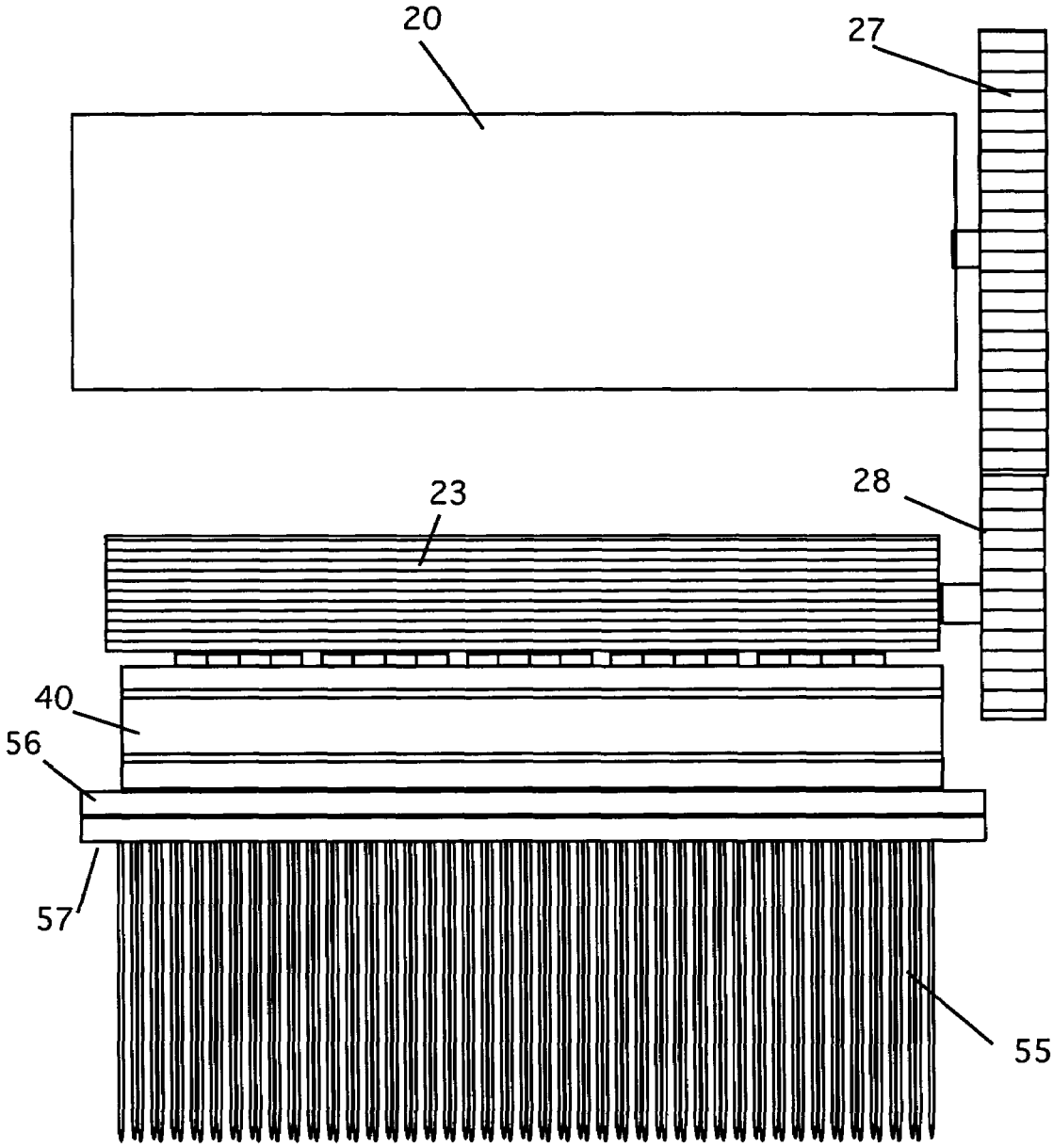
FIG. 13 is a diagrammatic view of the needle drive assembly, showing the placement and relationship of all the parts of the drive assembly with no housing shown.

FIG. 4*b* is a right side front perspective view of the needle drive assembly. Here, the motor 20 is shown as before. The door 22 to the cam cylinder is removed, showing the cam cylinder 23. The motor 20 drives the cam cylinder to operate the machine. The motor has an output shaft 24 that mechanically connect to the cam cylinder shaft 25. FIG. 13 shows gears 27 and 28 for this mechanical connection, but other methods, such as drive belts may be used. The gears are covered with a guard 26 for safety as well as cleanliness.

Figure 5:
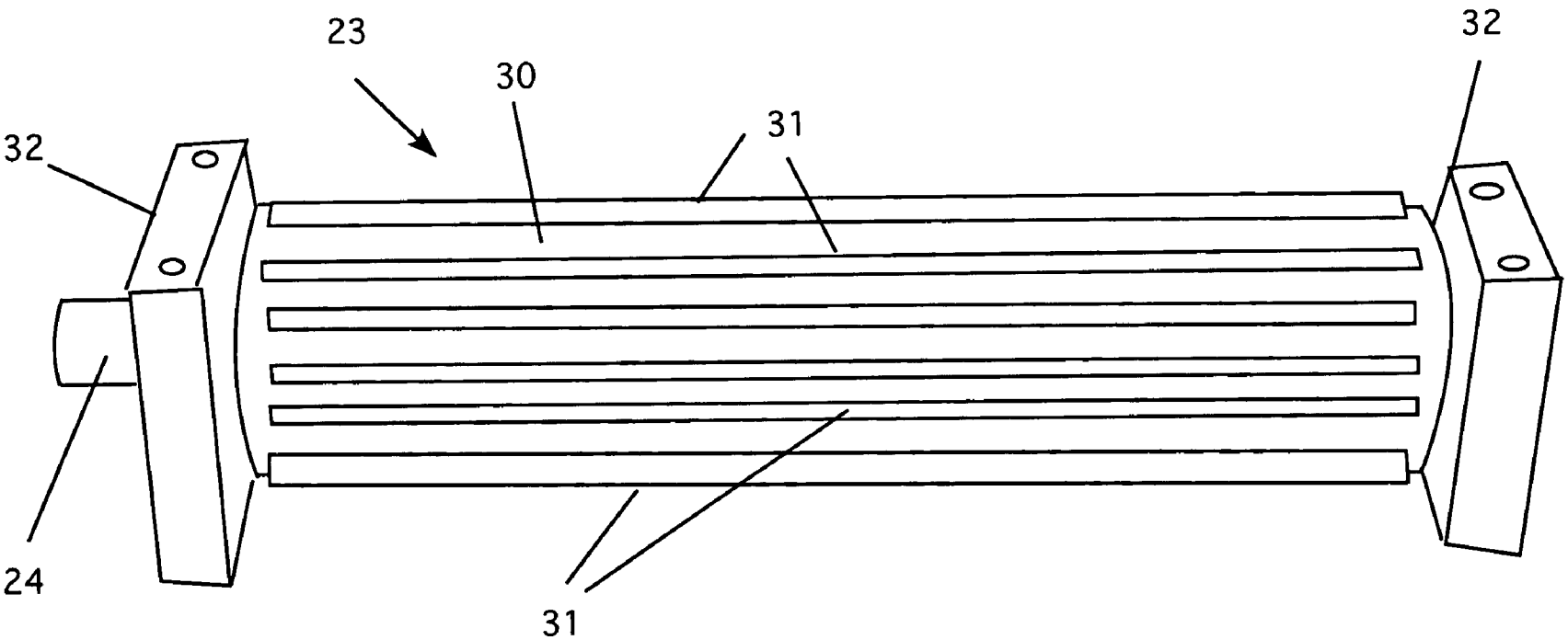
FIG. 5 is a detail view of the cam cylinder.

FIG. 5 is a detail view of the cam cylinder 23. The cam cylinder has a cylindrical body 30 that has a number of ribs 31 extending outward from it. The cylinder body has a shaft 25 and supported on the ends by bearings in square housings 32 that conform the outer housing 21.

Figure 6:
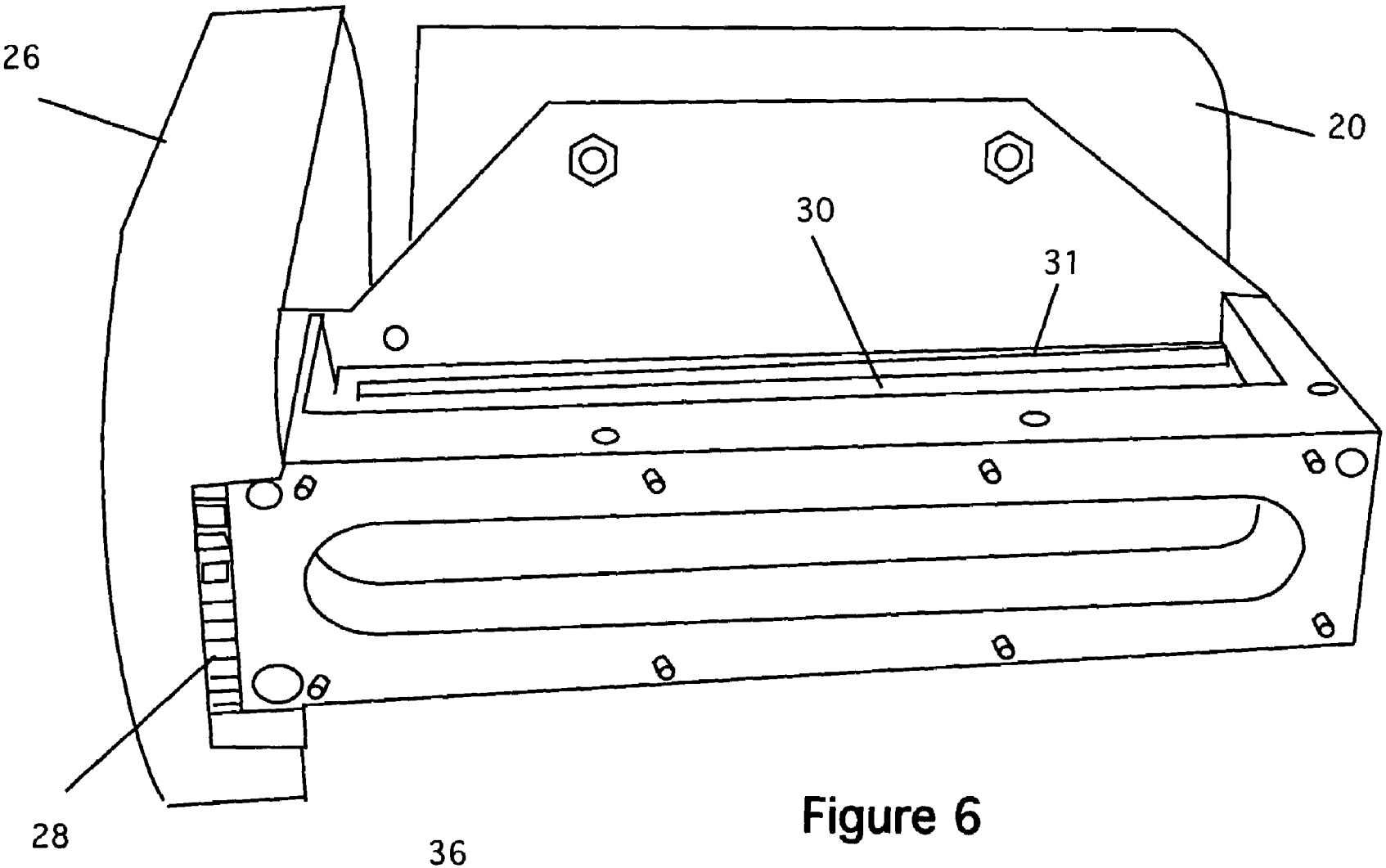
FIG. 6 is a detail view of the needle drive housing showing the can follower compartment.

FIG. 6 is a detail view of the upper portion of the needle drive housing 21 showing the can follower compartment. Here, the guard 26 and gear 28 are shown along with the motor 20. At the base of the upper part of the housing 21 is a compartment 36 for the cam follower. Note that the cam 30 and one of the ribs 31 can be seen in the center portion of the upper portion of the housing.

The cam cylinder and cam follower act as a "means for periodically compressing said top plate in a downward motion for a limited period of time". This produces a number of "compression periods" and a number of "non-compression periods".

Figure 7:
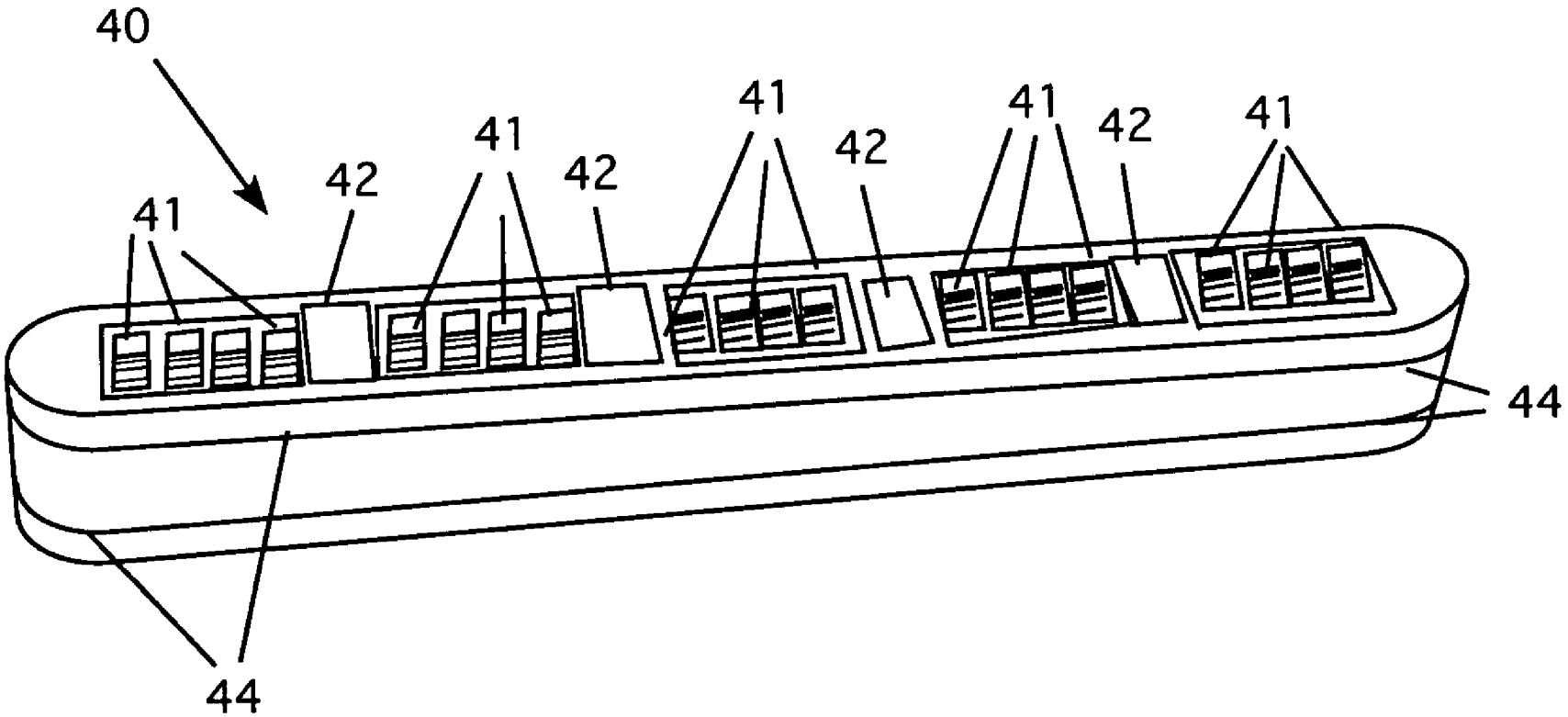
FIG. 7 is a perspective top view of the cam follower.

FIG. 7 is a perspective top view of the cam follower 40. The cam follower 40 has an ovular body 40*a*. The top has a number of roller bearings 41 that are shaft-mounted in the body (see FIG. 9). As the cam is turned, the ribs make contact with the roller bearings on the cam follower, which is then pushed downward to make contact with the needle plate (see below). Roller bearings are preferred because the do not heat up excessively during the operation of the machine. Note that the spaces in between the groups of bearings are filled with shaft support members 42.

Figure 8:
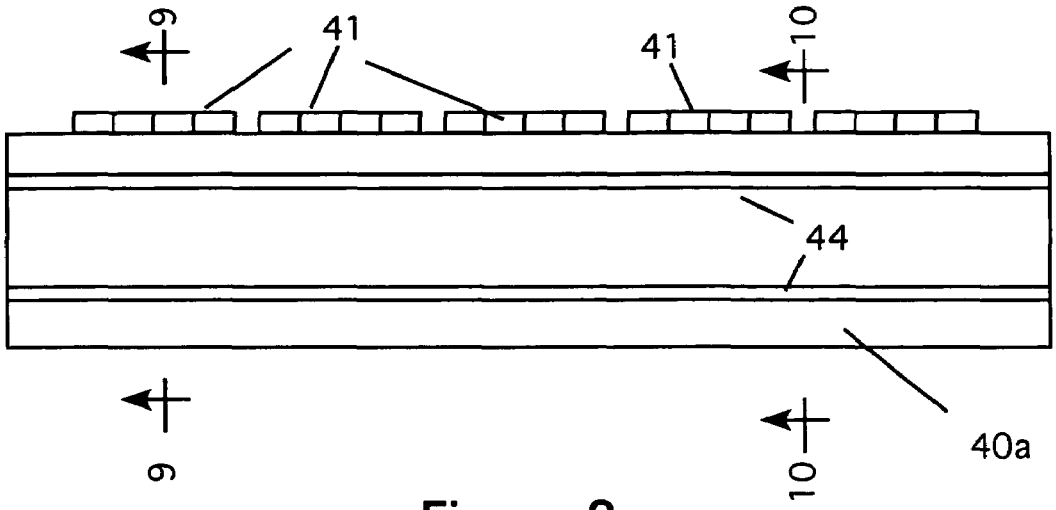
FIG. 8 is a side view of the cam follower.

FIG. 8 is a side view of the cam follower 40. As mentioned above, the roller bearings 41 are shown. To keep the bearings lubricated, oil is pumped into the upper portion of the housing. To retain the oil, o-rings 44 are placed around the follower body as shown. The o-rings act like piston rings in a piston engine to retain the oil as the follower is reciprocated within the housing.

Figure 9:
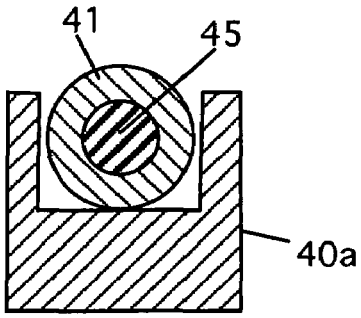
FIG. 9 is a cross-sectional view of the cam follower taken along the lines 9—9 of FIG. 8.

FIG. 9 is a cross-sectional view of the cam follower taken along the lines 9—9 of FIG. 8. Here, a roller bearing 41 is shown with the bearing shaft 45 through the center. In the preferred embodiment, the bearings are 1-inch o. d. and ½-inch wide. The bearing shaft has a ½-inch o. d.

Figure 10:
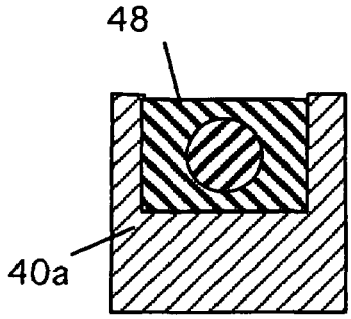
FIG. 10 is a cross-sectional view of the cam follower taken along the lines 10—10 of FIG. 8.

FIG. 10 is a cross-sectional view of the cam follower taken along the lines 10—10 of FIG. 8. Here, a section of the shaft support 46 is shown. The shaft support 46 is a series of portions of the cam follower that maintain the shaft in position. The shaft support section also retains the bearing sets in position. Note that the shaft support sections also contain caps that fit over the shaft to secure it in place.

Figure 11:
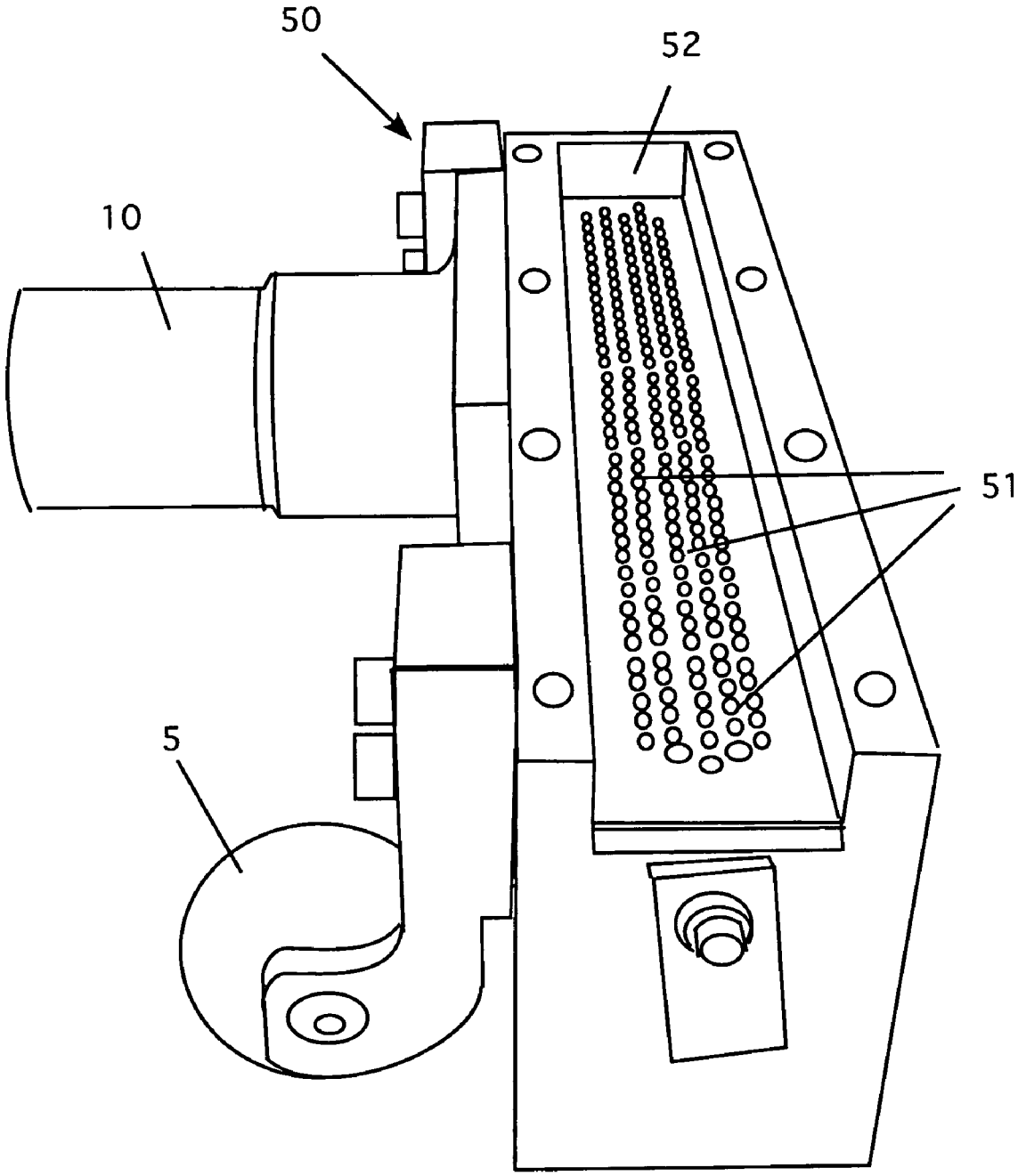
FIG. 11 is a side perspective view of lower portion of the needle drive housing.

FIG. 11 is a side perspective view of lower portion 50 of the needle drive housing. This piece acts as the needle support. Note that wheels 5 can be attached to the housing, if desired. The vacuum nozzle 10 is shown attached to the housing as well. The lower portion has a number of holes 51 that retain the needles. Note that the top of the lower portion forms a trough 52 that holds the drive plate and rubber piece (discussed below).

Figure 12:
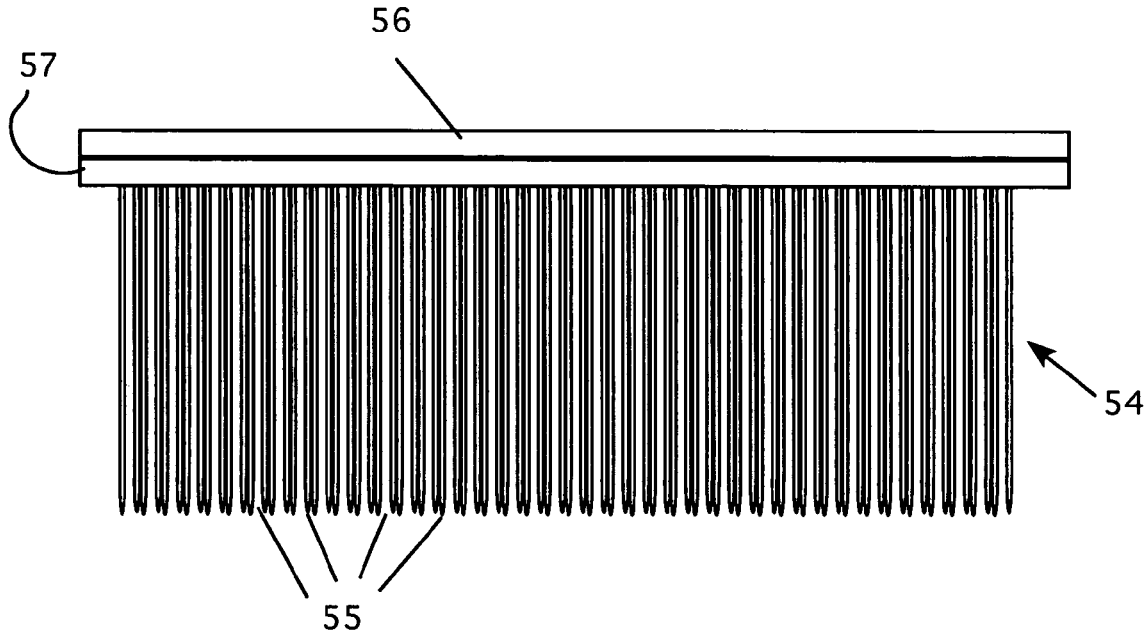
FIG. 12 is a front view of the needle assembly.

FIG. 12 is a front view of the needle assembly 54. This assembly has a number of needles 55 in a multiple row configuration. FIG. 11 shows five rows of needle supports. In the preferred embodiment, each row has 42 needles. Of course, these numbers and configurations can be varied, as desired. The important thing is that sufficient needles are used to create a tight pattern, which provides the most efficient floor treatment. The needles are held in place by a metal plate 56, which fits into the trough 52 on the lower portion 50. The cam follower makes contact with this plate as it is pushed down by the cam. Below the metal plate 56 is a rubber form 57. The rubber form is a resilient member. This form also sits in the trough 52 under the metal plate 56. After the cam follower has pushed the metal plate down, the rubber form resiliently causes the metal plate to rise in anticipation of the next operation of the cam ribs on the cam follower. Thus, the rubber form acts as a "means for moving said top plate upward during said number of non-compression periods". In this way, the needles are reciprocated in the housing to make contact with the floor surface.

FIG. 13 is a diagrammatic view of the needle drive assembly, showing the placement and relationship of all the parts of the drive assembly with no housing shown. Here, the motor 20 is shown above the cam cylinder 23. Gears 27 and 28 are shown attached to their appropriate shafts. An discussed above, the motor turns the cam cylinder 23, which in turn causes the cam follower 40 to be pushed down against the top plate 56, which in turn pushes down the needles 55. The downward motion happens every time one of the ribs on the cam cylinder contacts the cam follower. In between contacts by the ribs, the rubber form 56 pushes up the top plate, which raises the needles for the next stroke. In this way, the needles are reciprocated at a high rate of speed. This is highly effective in breaking up the top surface of a concrete floor. Typical travel of the needles is between about 1/16-inch and 3/16-inches.

Figure 14:
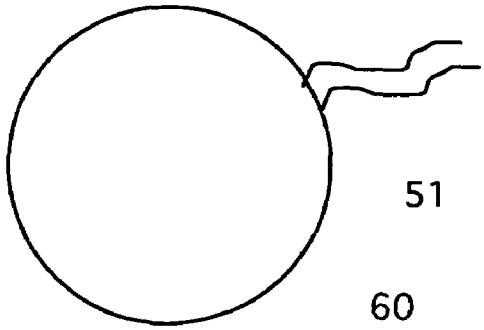
FIG. 14 is an end view of an electromagnet as part of a second embodiment of the needle drive unit.
Figure 15:
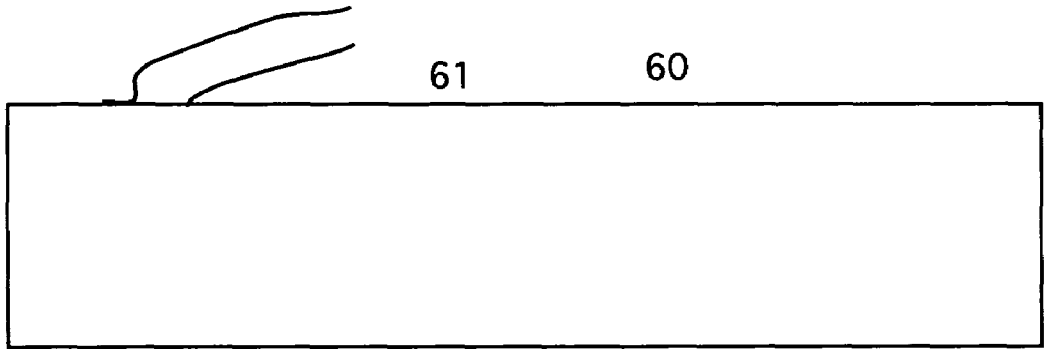
FIG. 15 is a side view of an electromagnet as part of a second embodiment of the needle drive unit.

FIGS. 14 and 15 show an electromagnet as part of a second embodiment of the needle drive unit. The electromagnet 60 is a cylinder that has a pair of wires 61 the feed from it. These wires connect to a power source 77 (see FIG. 18).

Figure 16:
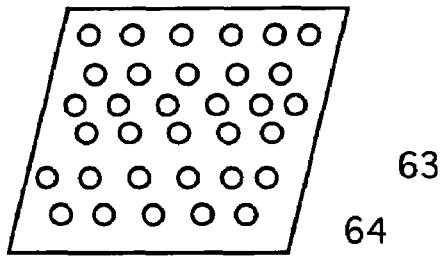
FIG. 16 is a top view of a single needle head in the second embodiment.

FIG. 16 is a top view of a single needle head or needle set 63 in the second embodiment. In this embodiment, the needles are separated into distinct groups. FIG. 16 shows one set 63 that has a number of needles 64. Note that the needle pattern can be varied and is not limited to that shown.

Figure 17:
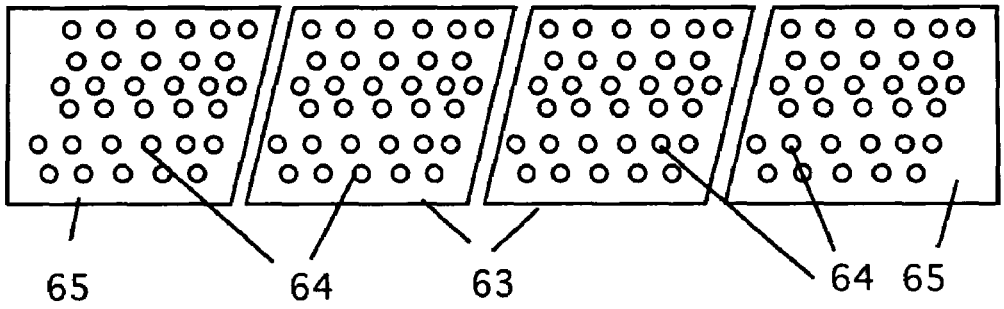
FIG. 17 is a top view of a number of needle heads positioned in sequence.

FIG. 17 is a top view of a number of needle sets positioned in sequence. Note that the end pieces 65 have squared ends to fit into the frame. However, the opposite end is angled. This is done to allow the needles to seat properly in the unit. Note that the center portions 63 are angled on both ends, as shown. Note that the preferred angle is about 30 degrees.

Figure 18:
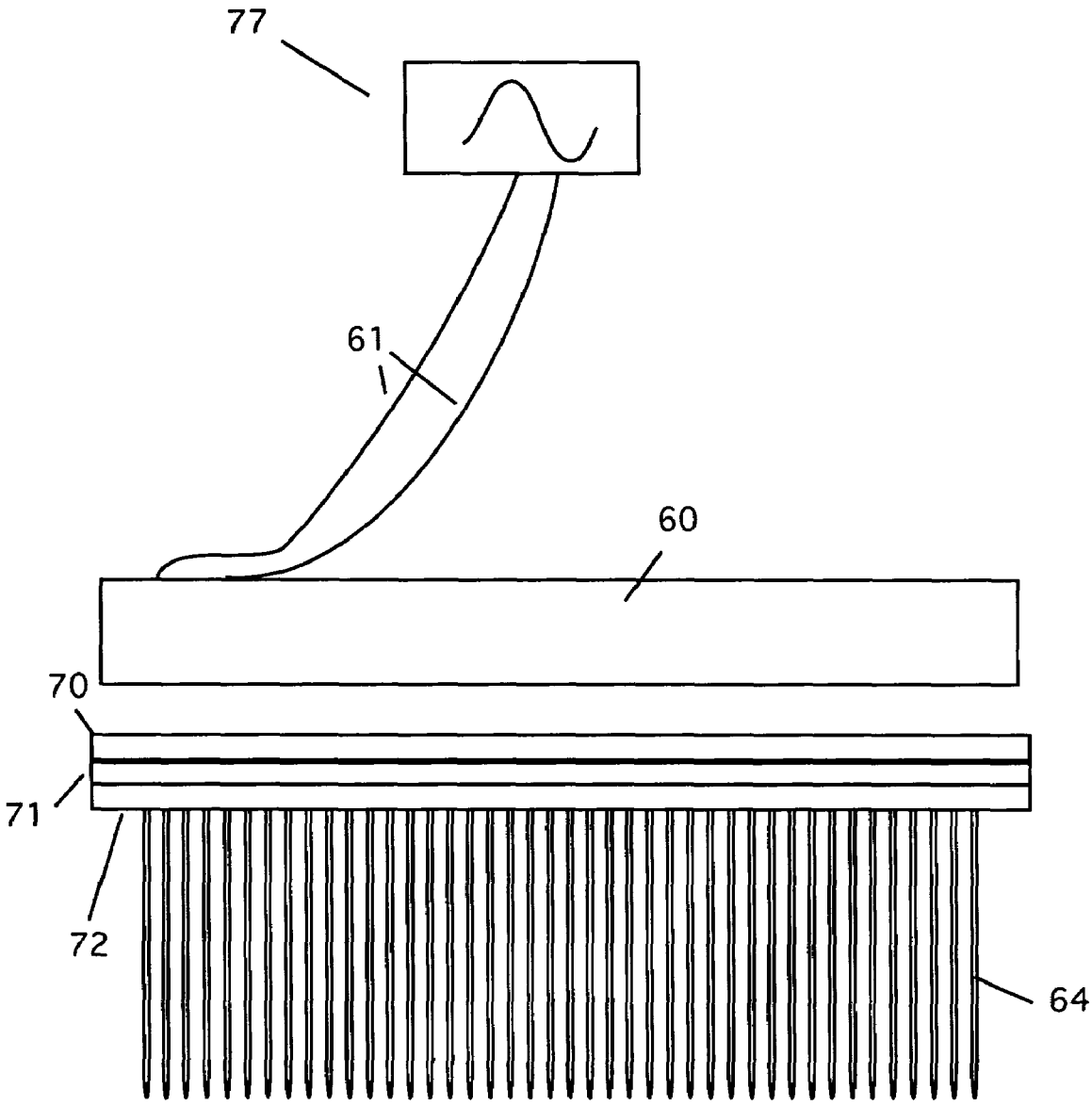
FIG. 18 is a diagrammatic view of the needle drive assembly of the second embodiment showing the placement and relationship of the key parts of the drive assembly with no housing shown.

FIG. 18 is a diagrammatic view of the needle drive assembly of the second embodiment showing the placement and relationship of the key parts of the drive assembly with no housing shown. Here, the motor and cams structure is eliminated. The magnet 60 is positioned above the needle assembly as shown. The magnet's wires connect to a power source 77 as shown. This power source is suitable for the magnet to operate.

The needle assembly is similar to that of the first embodiment, except that in this embodiment, there is a top steel plate 70, a center rubber portion 71 and a bottom steel plate 72. In this way, the magnet works to lift the needles in one part of the cycle and the rubber works to return the needles to their lower position for the next up cycle.

Due to the high frequency and speed of operation, the rubber portion in both embodiments must be a rubber capable of handling high temperatures and a high duty-cycle of compression cycles.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A machine for preparing floors for refinishing comprising:

a) a frame;

b) a plurality of wheels, attached to said frame;

c) a top plate;

d) a plurality of needles fixedly attached to said top plate, having a top and a bottom, and extending downward therefrom;

e) a housing for holding said plurality of needles such that said top plate is supported from below;

f) a means for periodically compressing said top plate in a downward motion for a limited period of time, thereby producing a number of compression periods and a number of non-compression periods; and g) a means for moving said top plate upward during said number of non-compression periods, said means for moving being attached to the bottom of said top plate.

2. The machine of claim 1 wherein the means for periodically compressing said top plate comprise:

a) a cam cylinder having a plurality of ribs extending outwardly therefrom;

b) a cam follower, positioned adjacent to said cam cylinder such that said plurality of ribs of said cam cylinder make periodic contact with said cam follower such that when each of said plurality of ribs makes contact with said cam follower, said cam follower is pushed in a downward motion for a limited period of time; and c) a means for rotating said cam cylinder.

3. The machine of claim 2 wherein the means for rotating said cam cylinder includes a motor.

4. The machine of claim 2 wherein the cam follower includes a plurality of roller bearings, positioned on a shaft within said cam follower.

5. The machine of claim 2 wherein the cam follower includes at least one o-ring, positioned around said cam follower.

6. The machine of claim 1 wherein means for moving said top plate upward comprises a resilient member attached to the bottom of said top plate.

7. The machine of claim 6 wherein the resilient member attached to the bottom of said top plate comprises a rubber form.

8. The machine claim 1 further comprising a means for propelling said plurality of wheels, installed in said frame.

9. The machine of claim 1 further comprising a means for collecting dust, installed in said frame.

10. A machine for preparing floors for refinishing comprising:

a) a frame;

b) a plurality of wheels, attached to said frame;

c) a plurality of needle sets each needle set having:

i) a top plate;

ii) a bottom plate;

iii) a resilient member attached to the bottom of said top plate; and iv) a plurality of needles extending downward from said bottom plate;

f) a housing for holding said plurality of needle sets such that said top plate of each of the needle sets and resilient members, and bottom plates are supported from below;

g) a means for periodically compressing each of the top plates of each of said needle sets in a downward motion for a limited period of time; and h) a means for controlling the means for periodically compressing the top plate of each of said needle sets in a downward motion for a limited period of time.

11. The machine of claim 10 wherein the means for periodically compressing said top plate of each of said needle sets comprise:

a) a cam cylinder having a plurality of ribs extending outwardly therefrom;

b) a cam follower, positioned adjacent to said cam cylinder such that said plurality of ribs of said cam cylinder make periodic contact with said cam follower such that when each of said plurality of ribs makes contact with said cam follower, said cam follower is pushed in a downward motion for a limited period of time; and c) a means for rotating said cam cylinder.

12. The machine of claim 11 wherein the means for rotating said cam cylinder includes a motor.

13. The machine of claim 11 wherein the cam follower includes a plurality of roller bearings, positioned on a shaft within said cam follower.

14. The machine of claim 11 wherein the cam follower includes at least one o-ring, positioned around said cam follower.

15. The machine of claim 10 wherein the resilient member attached to the bottom of each of said top plates comprises a rubber form.

16. The machine claim 10 further comprising a means for propelling said plurality of wheels, installed in said frame.

17. The machine of claim 10 further comprising a means for collecting dust installed in said frame.

18. The machine of claim 10 wherein the means for periodically compressing said top plate of each of said needle sets includes:

a) an electromagnet, positioned above said plurality of needle sets; and b) a power source to operate said electromagnet.

* * * * *